United States Patent [19]

Travor et al.

[11] 3,994,233

[45] Nov. 30, 1976

[54] INITIATOR CARTRIDGE

[75] Inventors: Bruce W. Travor, Holland, Pa.; Lennord L. Pitney, Park Rapids, Minn.

[73] Assignee: The United States of America as represented by the Secretary of the Army, Washington, D.C.

[22] Filed: Apr. 10, 1975

[21] Appl. No.: 566,867

[52] U.S. Cl. ..... 102/85.2; 102/70 R

[51] Int. Cl.[2] ..... F42C 9/00

[58] Field of Search ..... 102/85.2, 85.6, 85, 102/70 R, 37.7

[56] References Cited

UNITED STATES PATENTS

| | | | |
|---|---|---|---|
| 709,854 | 9/1902 | Puff | 102/85.2 X |
| 993,091 | 5/1911 | Meigs et al. | 102/85.2 |
| 1,533,756 | 4/1925 | Panigatti | 102/85.2 |
| 2,515,040 | 7/1950 | Hatcher | 102/85.2 X |
| 2,954,735 | 10/1960 | Ellern et al. | 102/85.2 X |

FOREIGN PATENTS OR APPLICATIONS

| | | | |
|---|---|---|---|
| 27,609 | 1903 | United Kingdom | 102/85.2 |

*Primary Examiner*—David H. Brown
*Attorney, Agent, or Firm*—Nathan Edelberg

[57] ABSTRACT

An initiator cartridge having a close tolerance time delay mechanism to selectively provide substantially the same predetermined time delay for cartridge propellant ignition at extreme high and low temperatures as at an ambient temperature. A delay element casing has a body that contains a plurality of delay composition columns of predetermined varying lengths. A primer retaining dial is rotatably mounted in the delay case and has a central rearmost primer and a passageway for selectively placing one of the delay columns in fluid communication with the primer.

5 Claims, 5 Drawing Figures

INITIATOR CARTRIDGE

The invention described herein may be manufactured, used and licensed by or for the Government for governmental purposes without the payment to us of any royalty thereon.

In prior initiators containing a delay column, the latter has been sensitive to temperature change which affects its burning rate and the amount of time delay. This results in unsatisfactory time delay tolerances when the initiator is utilized in extreme temperature environments.

It is an object of the invention to provide an initiator with a predetermined close tolerance time delay, notwithstanding utilization in extreme temperature environments.

Another object of the invention is to provide such an initiator that can be selectively adjusted by an operator at the time of usage.

These and other objects, features and advantages will become more apparent from the following description and accompanying drawings in which.

Figure 1:
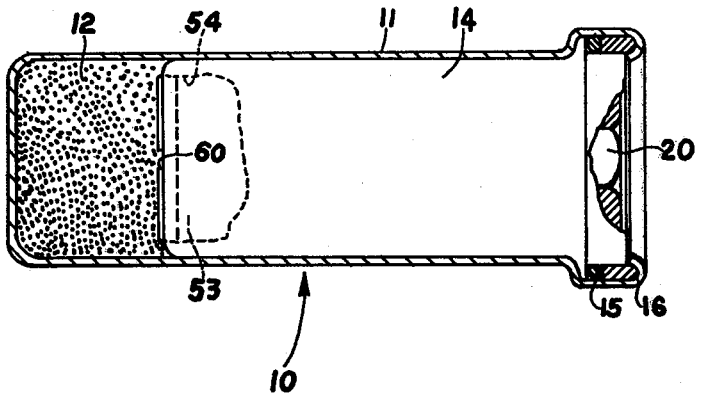
FIG. 1 is a sectional view, partially broken away, of a preferred initiator cartridge embodying the principles of the invention.
Figure 2:
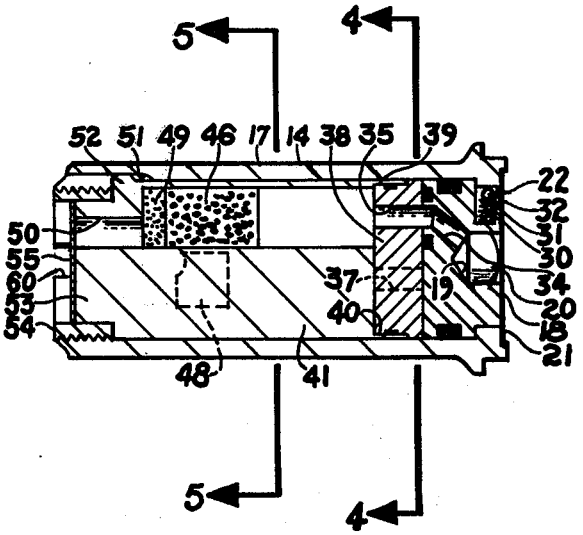
FIG. 2 is a sectional view of the FIG. 1 arrangement with certain parts omitted.
Figure 3:
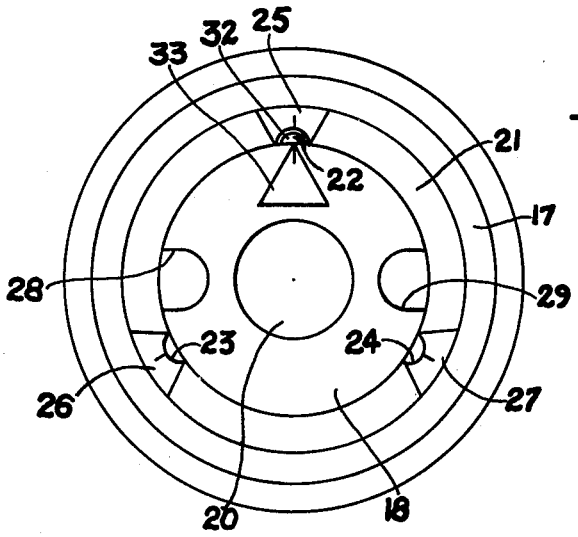
FIG. 3 is a rearward end view of the FIG. 2 delay element.
Figure 4:
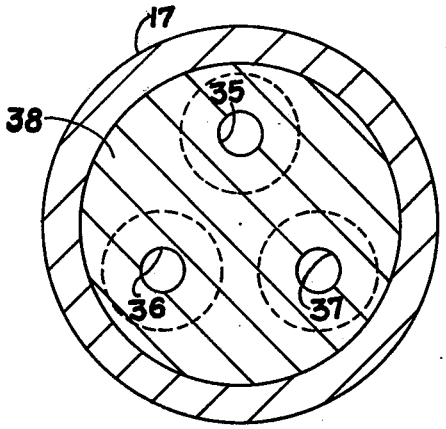
FIG. 4 is a sectional view taken along line 4—4 of FIG. 2.
Figure 5:
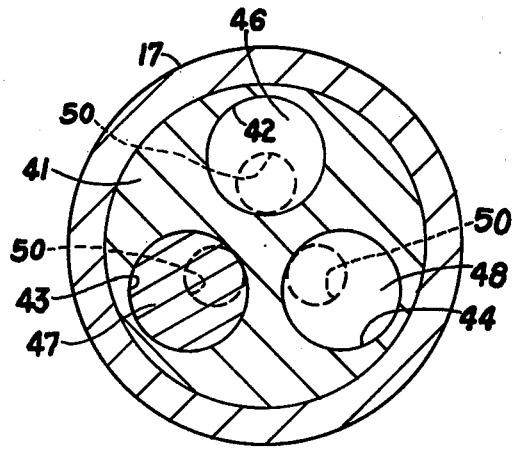
FIG. 5 is a sectional view taken along line 5—5 of FIG. 2.

The initiator cartridge, shown generally at 10 (FIG. 1), includes a cartridge case 11 containing a propellant charge 12 for delivering developed pressure gas through an initiator forward opening (not shown) and a time delay element 14. The rearward end of the cartridge case, upon assembly, is crimped over an O-ring seal 15 and retaining ring 16 at the rearward end of the aluminum casing 17 (FIGS. 2–5) of time delay element 14. Rotatably mounted in the rearward end of substantially cylindrical casing 17 is a primer retainer dial 18 (FIG. 2) that has a rearwardly opening recess 19 containing a suitable percussion primer 20. An inwardly directed annular lip 21 on the rearward end of casing 17 has a plurality (preferably 3) of arcuate or concave longitudinal slots 22, 23, 24 (FIG. 3), circumferentially spaced equidistant from each other in the inner surface of lip 21, adjacent corresponding indicia markings 25, 26, 27 on the rearward surface of lip 21 that represent settings for ambient, high and low temperature ranges, respectively, as will be hereinafter described.

Dial 18, having in its rearward portion a pair of diametrically opposed wrench notches or end slots 28, 29 to facilitate imparting rotational movement of dial 18, has a cylindrical recess 30 in the rearward portion sidewall spaced circumferentially at substantially 90° from notches 28, 29, and in longitudinal alignment with its representative indicia marking 33 on the dial rearmost surface. Recess 30 contains a compression spring 31 and ball detent 32 for selective engagement in mating arcuate lip slots 22, 23, 24. The dial 18 also contains a passageway 34 the axis of which is at least partially inclined to assure intermediate fluid communication between primer recess 19 and a selected one of three longitudinal passages 35, 36, 37 provided in primer inlet plate 38 (FIGS. 2, 4) at equally and circumferential spaced locations.

Primer inlet plate 38 has a forward reduced peripheral portion 39 that is adhesively and sealingly secured in a rearwardly opening annular recess 40 in the end of substantially cylindrical delay body 41. Delay body 41 has three longitudinally extending cylindrical compartments or chambers 42, 43, 44 (FIG. 5) that are equally and circumferentially spaced and respectively containing predetermined varying lengths of delay mix composition columns 46, 47, 48 and a corresponding flash igniter mix 49 located adjacent a corresponding forward exit port or flash hole 50.

The forwardmost inner surface of casing 17 is threaded and contains an interrupting longitudinal keyway 51 that accommodates an integral key or protrusion 52 on the external surface of delay body 41 rearwardly adjacent its forwardmost reduced end 53 which permits an appropriate externally threaded retaining ring 54 to shoulder and secure the inserted delay body within casing 17. The forward end of retaining ring 54 perferably has a pair of diametrically opposed slots 60 to facilitate use of a screw driver upon assembly and/or disassembly. A rupturable closure igniter disc 55 is inserted within ring 54 and cemented with a suitable sealing compound to the forward surface of the delay body reduced portion 53.

With the parts assembled as shown in the drawings, an ambient operative temperature range of 20° F to 100° F will produce the predetermined desired delay tolerance upon ignition of medium length delay mix column 46. Upon selective adjustment of dial 18 to the high operative temperature range of 100° F to 200° F wherein ball detent 32 seats in slot 23, the passages 34 and 36 will be aligned to ignite a predetermined longer delay column 47 and thereby provide the same amount of time delay. Upon alignment of passages 34 and 37 to ignite a shorter delay column 48 when dial 18 has been moved to seat ball detent 32 in slot 24 in the low operative temperature range of −65° F to 20° F, the same predetermined time delay is obtained.

Various modifications, alterations or changes may be resorted to without departing from the scope of the invention as defined in the appended claims.

We claim:

1. A close tolerance time delay mechanism, comprising a delay element casing adapted to be inserted in an initiator cartridge case and having a delay body longitudinally keyed thereto, a plurality of delay composition columns of predetermined varying lengths, each column being seated in said delay body adjacent a corresponding forward exit port, a primer inlet plate secured to said delay body and having a plurality of openings therethrough aligned with respective ones of said columns, and a primer retaining dial rotatably mounted in said delay casing and having a central rearmost primer and means including a dial passageway for selectively placing one of said openings in fluid communication with said primer.

2. The structure in accordance with claim 1 wherein said dial has a cylindrical peripheral recess extending radially in the sidewall of said dial, a spring biased ball in said recess for engaging a predetermined inner surface of said casing, said casing inner surface having a plurality of circumferentially spaced arcuate recesses for selectively receiving said ball.

3. The structure of claim 2 whrein said dial has indicia means on its rearward end surface in longitudinal alignment with said cylindrical recess, and said casing having a plurality of indicia means circumferentially spaced on a rearward facing surface thereof and in corresponding longitudinal alignment with said casing recesses.

4. The structure of claim 3 wherein said dial rearward end surface has a pair of diametrically opposed slots to facilitate imparting rotation of said dial relative to said casing.

5. In a pressure gas generating initiator having a cartridge case containing a forward propellant charge and a close tolerance time delay mechanism rearward of said propellant charge, said mechanism including a delay element casing secured in said initiator cartridge case and having a delay body longitudinally keyed thereto, a plurality of delay composition columns of predetermined varying lengths, each column being seated in said delay body adjacent a corresponding forward exit port, a primer inlet plate secured to said delay body and having a plurality of openings therethrough aligned with respective ones of said columns, and a primer retaining dial rotatably mounted in said delay casing and having a central rearmost primer and means including a dial passageway for selectively placing one of said openings in fluid communication with said primer.

* * * * *